US009905952B2

(12) United States Patent
Brungard et al.

(10) Patent No.: US 9,905,952 B2
(45) Date of Patent: Feb. 27, 2018

(54) ELECTRICAL POWER CONTACT

(71) Applicant: FCI USA LLC, Etters, PA (US)

(72) Inventors: Thomas A. Brungard, York, PA (US); Michael Blanchfield, Etters, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/328,771

(22) PCT Filed: Jul. 15, 2015

(86) PCT No.: PCT/US2015/040511

§ 371 (c)(1),
(2) Date: Jan. 24, 2017

(87) PCT Pub. No.: WO2016/014308

PCT Pub. Date: Jan. 28, 2016

(65) Prior Publication Data

US 2017/0214165 A1 Jul. 27, 2017

Related U.S. Application Data

(60) Provisional application No. 62/028,449, filed on Jul. 24, 2014.

(51) Int. Cl.
*H01R 4/10* (2006.01)
*H01R 13/10* (2006.01)
(Continued)

(52) U.S. Cl.
CPC ..... *H01R 13/10* (2013.01); *H01R 4/185* (2013.01); *H01R 12/58* (2013.01); *H01R 12/7088* (2013.01); *H01R 13/055* (2013.01)

(58) Field of Classification Search
CPC ..... H01R 13/10; H01R 13/055; H01R 4/185; H01R 12/7088; H01R 12/58; H01R 13/113
(Continued)

(56) References Cited

U.S. PATENT DOCUMENTS 5,588,884 A 12/1996 Rudoy et al.
8,419,486 B2 * 4/2013 Tyler ..... H01R 13/113 439/842
(Continued)

FOREIGN PATENT DOCUMENTS

EP 0 656 673 A2 6/1995
EP 0 793 302 A1 9/1997

OTHER PUBLICATIONS

International Search Report and Written Opinion for International Application No. PCT/US2015/040511 dated Oct. 16, 2015.
(Continued)

*Primary Examiner* — Jean F Duverne
(74) *Attorney, Agent, or Firm* — Wolf, Greenfield & Sacks, P.C.

(57) ABSTRACT

Electrical power contacts (100) are described having a mounting portion (114), a mating portion (102), and a transition region (116) that extends between the mounting portion and the mating portion. The mating portion can define first and second contact blades (104, 106) that are spaced from each other to define a receptacle that can be sized to receive a complementary electrical power contact (200). The transition region can be sized and shaped so as to transmit electrical power between the mounting portion and the mating portion.

19 Claims, 4 Drawing Sheets

(51) Int. Cl.

| | |
|---|---|
| ***H01R 13/05*** | (2006.01) |
| ***H01R 12/58*** | (2011.01) |
| ***H01R 12/70*** | (2011.01) |
| ***H01R 4/18*** | (2006.01) |

(58) Field of Classification Search
USPC ..... 439/877
See application file for complete search history.

(56) References Cited

U.S. PATENT DOCUMENTS

| | | | | |
|---|---|---|---|---|
| 9,142,902 | B2 * | 9/2015 | Glick | H01R 13/18 |
| 2002/0025732 | A1 * | 2/2002 | Hsieh | H01R 13/187<br>439/845 |

OTHER PUBLICATIONS

International Preliminary Report on Patentability for International Application No. PCT/US2015/040511 dated Feb. 2, 2017.

* cited by examiner

ELECTRICAL POWER CONTACT

The present application is a U.S. national stage filing under 35 U.S.C. § 371 based on International Application No. PCT/US2015/040511 entitled "ELECTRICAL POWER CONTACT", filed Jul. 15, 2015, which claims priority under 35 U.S.C. § 119(e) to U.S. Provisional Patent Application No. 62/028,449, filed Jul. 24, 2014, which are hereby incorporated by reference in their entireties.

BACKGROUND

Electrical assemblies can include at least one electrical conductor, and an electrical insulator that surrounds the electrical conductor. The at least one electrical conductor typically defines a first end for electrical connection to an electrical contact, and a second end for electrical connection to a mounting member. The electrical contact and the mounting member can be placed in electrical communication with respective complementary electrical components. The at least one electrical conductor can be configured to carry electrical power or data signals between the complementary electrical devices. The size of electrical power contacts and the current-carrying capacity of electrical power contacts are often competing design characteristics.

SUMMARY

In accordance with one embodiment, an electrical contact, such as an electrical power contact for example, can include a mounting portion con figured to electrically connect to an electrical cable. The electrical contact can further include a mating portion spaced from the mounting portion in a forward direction. The mating portion can include first and second contact blades spaced from each other along a second direction that is substantially perpendicular to the forward direction. The electrical contact can further include a transition region that extends from the mounting portion to the mating portion. The transition region can be configured to transmit electrical current from the mounting portion to the mating portion. The transition region can define a first end and a second end spaced from the first end in the forward direction. The first and second ends can define first and second heights, respectively, measured along a third direction that is substantially perpendicular to both the forward direction and the second direction, and second height can be greater than the first height.

In another example embodiment, an electrical contact, for instance an electrical power contact, includes a mounting portion and a mating portion spaced from the mounting portion in a forward direction. The mounting portion is configured to electrically connect to an electrical cable. The mating portion can include first and second contact blades spaced from each other along a second direction that is substantially perpendicular to the forward direction. Each of the first and second contact blades can define a respective first surface and a respective second surface spaced from the respective first surface along a third direction that is substantially perpendicular to both the forward direction and the second direction. One of the first and second contact blades can define a seam elongate along the forward direction. The seam can be closer to one of the first and second surfaces as compared to the other of the first and second surfaces.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
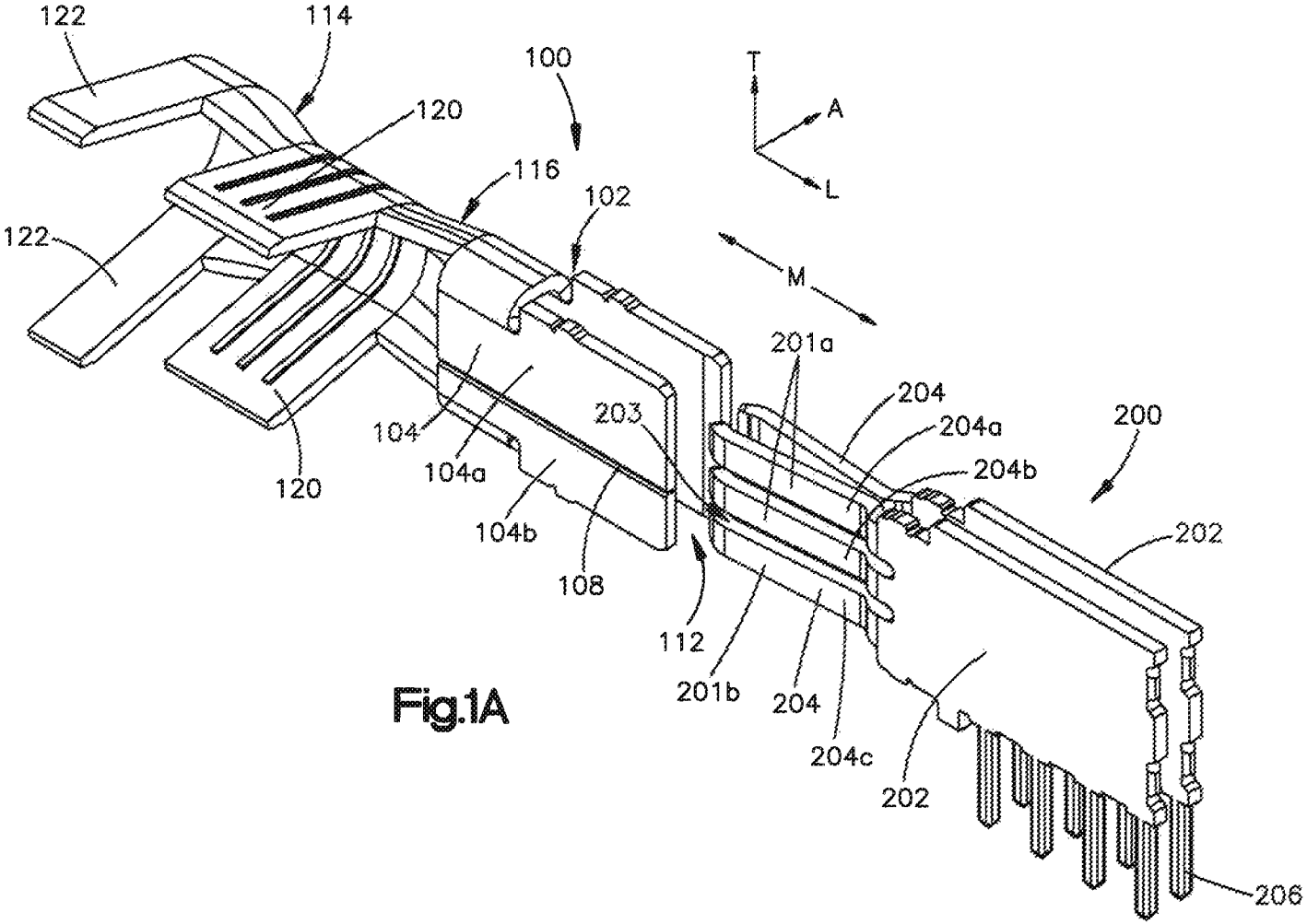
FIG. 1A is a perspective view of a portion of an electrical assembly constructed in accordance with one embodiment, showing an electrical contact of an electrical cable assembly of the electrical assembly aligned to be mated with a complementary electrical contact of the electrical assembly.

For convenience, the same or equivalent elements in the various embodiments illustrated in the drawings have been identified with the same reference numerals. Certain terminology is used in the following description for convenience only and is not limiting. The words "left," "right," "front," "rear," "upper," and "lower" designate directions in the drawings to which reference is made. The words "forward," "forwardly," "rearward," "inner," "inward," "inwardly," "outer," "outward," "outwardly," "upward," "upwardly," "downward," and "downwardly" refer to directions toward and away from, respectively, the geometric center of the object referred to and designated parts thereof. The terminology that is intended to be non-limiting includes the above-listed words, derivatives thereof and words of similar import.

Referring to FIGS. 1A-2D generally, an electrical assembly can include an electrical cable assembly that includes an electrical cable and an electrical contact 100, which can be configured as an electrical power contact 100. The electrical assembly can further include a complementary electrical component, such as an electrical connector that includes one or more electrical contacts, such as a complementary electrical contact 200, supported by a connector housing. The electrical contact 100 can be configured to be attached to the electrical cable so as to place the electrical cable in electrical communication with the electrical contact 100. The electrical connector assembly can further include a complementary electrical component. The electrical contact 100 is configured to mate with the complementary electrical component so as to place the complementary electrical component in electrical communication with the electrical contact 100, and thus the electrical contact 100 can also be referred to as a mating member. In particular, the electrical contact can be configured to mate with the complementary electrical contact 200 along a mating direction M so as to establish an electrical connection between the electrical contact 100 and the complementary electrical contact 200. The electrical cable assembly, including the electrical cable and the electrical contact 100, can be configured to carry electrical power or data signals as desired. For instance, in accordance with one embodiment, the complementary electrical component can carry electrical power, such that the electrical assembly is configured as an electrical power assembly. It should be appreciated that the complementary electrical component can be configured as any suitable constructed alternative electrical component as desired.

Various structures are described herein as extending horizontally along a first or longitudinal direction "L" and a second or lateral direction "A" that is substantially perpendicular to the longitudinal direction L, and vertically along a third or transverse direction "T" that is substantially perpendicular to the longitudinal and lateral directions L and A, respectively. As illustrated, the longitudinal direction "L" extends along a forward/rearward direction of the electrical contact 100, and defines a mating direction M along which one or both of the electrical contacts 100 and 200 are moved relative to the other so as to mate the electrical cable assembly with the complementary electrical component, and thus to mate the electrical contact 100 with the complementary electrical contact 200. For instance, the mating direction M of the illustrated electrical contact 100 is in a forward direction, and the electrical contact 100 can be unmated from the complementary power contact 200 by moving the electrical contact 100 in an opposed longitudinally rearward direction relative to the complementary electrical contact 200. As illustrated, the complementary electrical contact 200 can be moved relative to a substrate along the transverse direction T that defines a mounting direction of the complementary electrical component. As illustrated, the lateral direction A extends along a width of the electrical contact 100, the longitudinal direction L extends along a length of the electrical contact 100, and the transverse direction T extends along a height of the electrical contact 100.

Thus, unless otherwise specified herein, the terms "lateral," "longitudinal," and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical contact 100 as illustrated merely for the purposes of clarity and convenience, it being appreciated that these orientations may change during use.

With particular reference to FIGS. 2A-D, the electrical contact 100 can include a mounting portion 114 configured to electrically connect to an electrical cable. The electrical contact 100 can further include a mating portion 102 spaced from the mounting portion 114 in the forward direction. The mating portion 102 can be configured to be electrically mated with a complementary electrical component, such as the complementary electrical contact 200. The mating portion 102 can include a front end 102*a* and a rear end 102*h* opposite the front end in the rearward direction. In accordance with the illustrated embodiment, the mating portion 102 can include first and second contact blades 104 and 106, respectively, spaced from each other along the lateral direction A that is substantially perpendicular to the forward direction. The first and second contact blades 104 and 106 can be monolithic with each other. The front end 102*a* can define a tapered end. As shown, each of the first and second contact blades 104 and 106 define the rear end 102*b* and the front end 102*a* spaced from the rear end 102*b* in the forward direction. One of the first and second contact blades 104 and 106, respectively, can define a seam 108. In accordance with the illustrated embodiment, one of the first and second contact blades 104 and 106 can define the seam 108 that is oriented along the forward direction. The seam 108 can be elongate along the forward direction. In an example embodiment, the seam 108 is oriented solely along the forward direction. The seam 108 can extend entirely through the contact blade along the lateral direction A. Although the first contact blade 104 defines the seam 108 in the illustrated embodiment, it will be understood that the second contact blade 106 can alternatively define the seam 108 as desired.

Each of the contact blades 104 and 106 can define first and second surfaces 110*a* and 110*b* spaced from each other along the transverse direction T. The seam 108 can be spaced closer to one of the first and second surfaces 110*a* and 110*b* along the transverse direction T as compared to the other of the first and second surfaces 110*a* and 110*b*. The first and second contact blades 104 and 106 can be spaced apart from each other along the lateral direction A so as to define a receptacle 112 therebetween. The receptacle 112 can be sized so as to receive at least a portion of the complementary electrical contact 200. The first and second contact blades 104 and 106 can each include inner surfaces 110*c* that face each other. The first and second contact blades 104 and 106 can each include a respective outer surface 110*d* opposite the respective inner surface 110*c*. For instance, the outer surfaces 110*d* can be spaced from the respective inner surface 110*c* along the lateral direction A. The seam 108 can extend from the inner surface 110*c* to the outer surface 110*d* from the respective rear end 102*b* to the respective front end 102*a*.

Still referring to FIGS. 2A-D, in accordance with the illustrated embodiment, the electrical contact 100 can define a contact body 101 that defines an open end along the lateral direction A. The electrical contact 100 can further include the mounting portion 114 that is configured to electrically connect to an electrical cable. The mounting portion 114 can further be configured to physically attach to the electrical cable. The mounting portion 114 can include a pair of crimp arms 120 that extend from the contact body 101. The crimp arms 120 can be disposed at a front end 114*a* of the mounting portion 114. The mounting portion can further include a pair of strain relief arms 122 that are spaced rearward from the crimp arms 120 along the longitudinal direction L.

With continuing reference to FIGS. 2A-D, in accordance with the illustrated embodiment, the electrical contact 100 can further include a transition region 116 that extends from the mounting portion 114, in particular to the front end 114*a* of mounting portion 114, to the mating portion 102, in particular the rear end 102*b* of the mating portion 102. The transition region 116 can be configured to transmit electrical current, for instance an increased amount of electrical current as compared to similar portions of other electrical contacts, between the mating portion 102 and the mounting portion 114. For instance, the transition region 116 can transmit electrical current from the mounting portion 114 to the mating portion 102. The transition region can define a first end 116*a* and a second end 116*b* spaced from the first end 116*a* in the forward direction. The first and second ends 116*a* and 116*b* can define first and second heights, respectively, measured along the transverse direction T that is substantially perpendicular to both the forward direction and the lateral direction A. As shown, the second height can be greater than the first height. For instance, the transition region 116 can flare outwardly from the first end 116*a* to the second end 116*b*. It will be understood that the transition region 116 can define notches, can define steps, or can be otherwise shaped such that the second height is greater than the first height. For instance, the transition region 116 can extend from the mating portion 102 to the mounting portion 114, and at least a portion of the transition region 116 can define an outermost dimension that increases in the forward direction. In accordance with the illustrated embodiment, the first end 116*a* can be interconnected with the mounting portion 114. The second end 116*b* can be interconnected with the mating portion 102. The mounting portion 114, the mating portion 102, and the transition region 116 can all be monolithic with each other. Further, the transition region 116 can be curved along at least a portion of its length between the first end 116*a* and the second end 116*b*. For instance, the transition region 116 can be C-shaped. Further, the transition region 116 can have upper and lower ends spaced along the transverse direction T, such that the transition region 116 is open along the lateral direction A.

Still referring to FIGS. 2A-D, each of the first and second contact blades 104 and 106 can define the rear end 102*b* that can be disposed at the transition region 116, and the front end 102*a* opposite the rear end 102*b* in the forward direction. In an example embodiment, a select one of the first and second contact blades 104 and 106 defines a first portion 104*a* and a second portion 104*b* separated from the first portion 104*a* by the seam 108 that extends from the respective rear end 102*b* to the respective front end 102*a*. In accordance with the illustrated embodiment, the first portion 104*a* includes the first surface 110*a* and a third surface 110*e* spaced from the first surface 110*a* along the transverse direction T, and the second portion 104*b* defines the second surface 110*b* and the fourth surface 110*f* spaced from the second surface 110*b* along the transverse direction T. As shown, the third and fourth surfaces 110*e* and 110*f* can face each other so as to define the seam 108. The seam 108 can be spaced closer to one of the first and second surfaces 110*a* and 110*b* along the transverse direction T as compared to the other of the first and second surfaces 110*a* and 110*b*. For instance, in accordance with the illustrated embodiment, the first surface 110*a* and the third surface 110*e* defines a first distance $d_1$ along the transverse direction T, the second surface 110*b* and the fourth surface 110*f* define a second distance $d_2$ along the transverse direction T, and the first distance $d_1$ is greater than the second distance $d_2$. It will be understood that the seam 108 can be alternately disposed such that the second distance $d_2$ is greater than the first distance $d_1$.

The mating portion 102 can further include at least one first bridge element, for instance a first bridge element 118*a*, that connects the first portion 104*a* of a select one of the first and second contact blades 104 and 106 with the other of the first and second contact blades 104 and 106. The mating portion 102 can further include at least one second bridge element, for instance a second bridge element 118*b*, that connects the second portion 104*b* of a select one of the first and second contact blades 104 and 106 with the other of the first and second contact blades 104 and 106. Thus, the first bridge element 118*a* can be disposed on the opposite side of the seam 108 with respect to the second bridge element 118*b* along the transverse direction T. The first bridge element 118*a* can be substantially C-shaped so as to be connected with the first surface 110*a* of the first contact blade 104 and the first surface 110*a* of the second contact blade 106, and the second bridge element 118*b* can be substantially C-shaped so as to be connected with the second surface 110*b* of the first contact blade 104 and the second surface 110*b* of the second contact blade 106. As shown, the first and second bridge elements 118*a* and 118*b* can disposed at the rear end 102*b* of the mating portion 102, though it will be understood that the bridge elements can be alternatively located as desired. The transition region 116 can be connected to at least a portion of at least one of the first and second bridge elements 118*a* and 118*b*. For instance, the transition region 116 can be connected to at least a portion of both of the first and second bridge elements 118*a* and 118*b*. In an example embodiment, the first contact blade 104, the second contact blade 106, the first bridge element 118*a*, and the second bridge element 118*b* are all monolithic with one other.

Figure 1B:
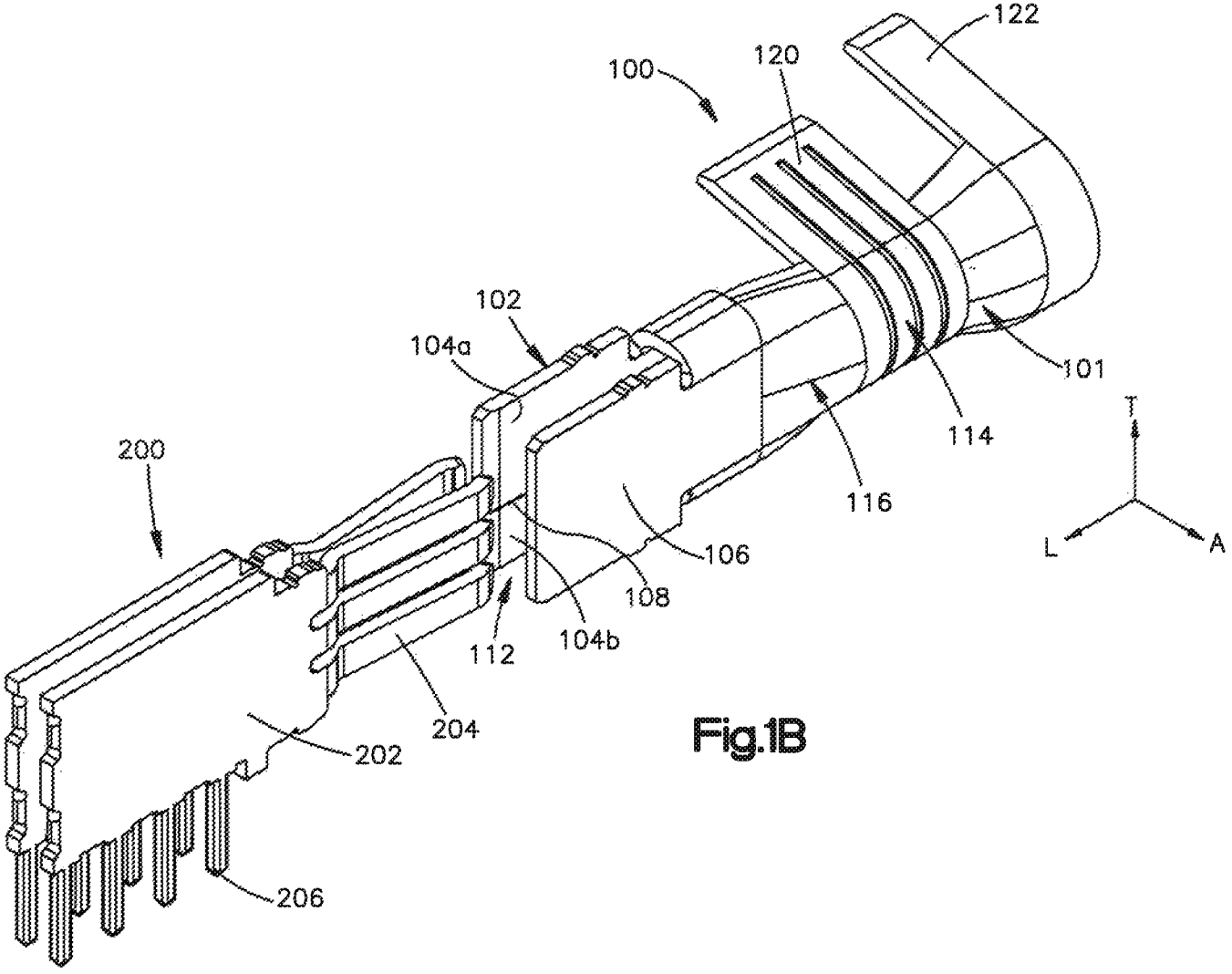
FIG. 1B is another perspective view of the electrical contact and the complementary electrical contact shown in FIG. 1A.
Figure 2A:
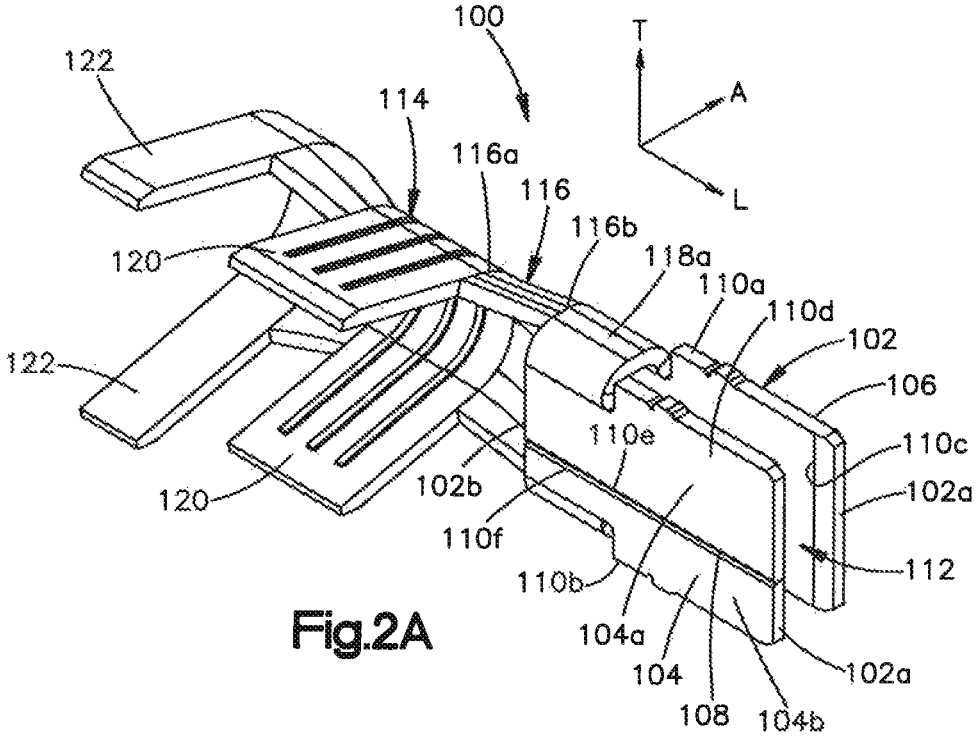
FIGS. 2A and 2B are perspective views of the electrical contact shown in FIGS. 1A and 1B.
Figure 2B:
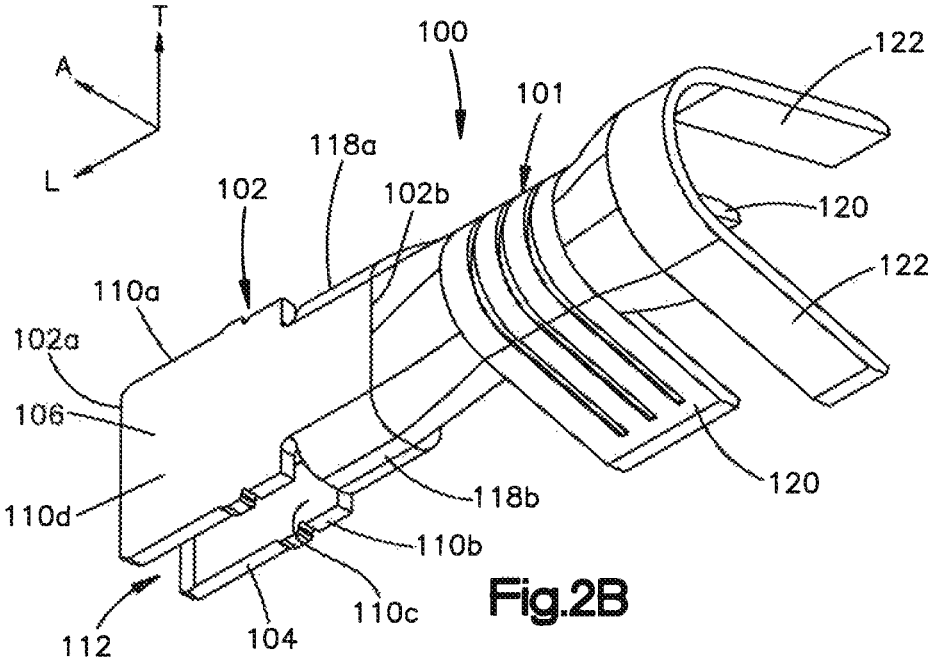
Figure 2C:
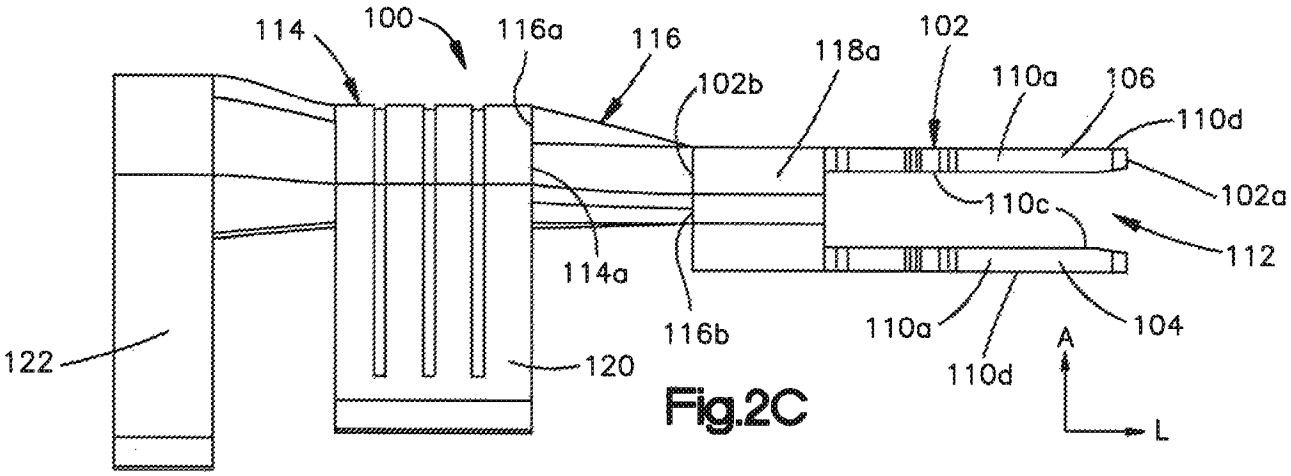
FIG. 2C is a top plan view of the electrical contact illustrated in FIGS. 2A and 2B.
Figure 2D:
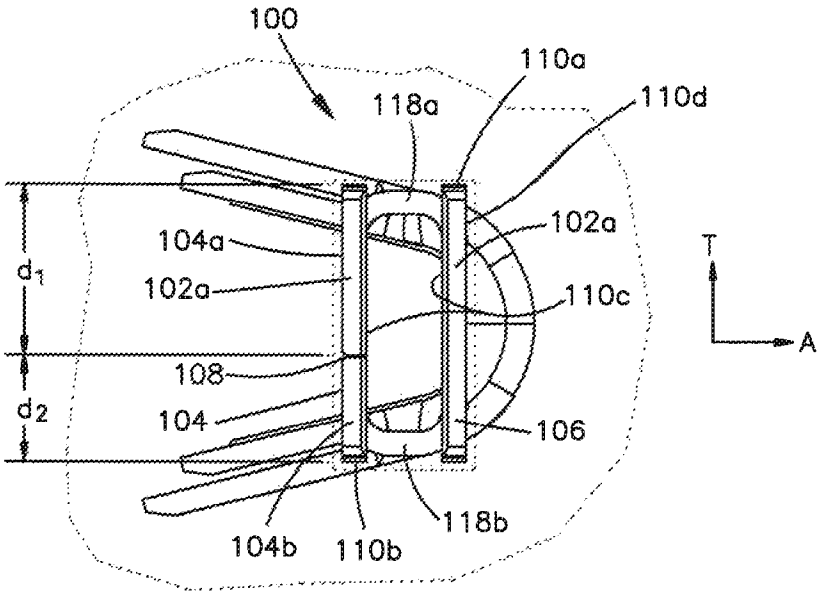
FIG. 2D is a front elevation view of the electrical contact illustrated in FIGS. 2A and 2B.

Referring also to FIGS. 1A and 1B, an electrical connector assembly can include the electrical contact 100 and the complementary electrical contact 200 that is configured to physically contact the mating portion 102 such that a first contact portion 201*a* of the complementary electrical contact 200 contacts the first portion 104*a* of the select one of the first and second contact blades 104 and 106, a second contact portion 201*b* of the complementary electrical contact 200 contacts the second portion 104*b* of the select one of the first and second contact blades 104 and 106, and the complementary electrical contact 200 defines a gap 203 between the first and second contact portions that is aligned with the seam 108 when viewed along the lateral direction A. In particular, the complementary electrical contact 200 can include a pair of plate members 202 spaced apart from each other along the lateral direction A. A plurality of complementary contact blades 204 can extend from each of the plate members 202 along the longitudinal direction L. Further, a plurality of mounting tails 206 can extend downward along the transverse direction T from the plate members 202. The mounting tails 206 can be configured to establish an electrical connection with a substrate when the electrical contact 200 is mounted to the substrate. The electrical connector assembly can include the electrical contacts 100 and 200 such that the inner surface 110*c* of the first contact blade 104 contacts a first plurality of complementary contact blades 204 when the electrical contact 100 is mated with the complementary electrical contact 200. The inner surface 110*c* of the second contact blade 106 can contact, when the electrical contact 100 is mated with the complementary electrical contact 200, a second plurality of complementary contact blades 204 that are spaced from the first plurality of complementary contact blades 204 along the lateral direction A.

In accordance with the illustrated embodiment, each of the first and second contact blades 104 and 106 contact three complementary contact blades 204 of the complementary electrical contact 200 when the electrical contact 100 is mated with the complementary electrical contact 200, though it will be understood that the first and second contact blades can be configured to contact any number of complementary contact blades 204 as desired. As further illustrated, the first portion 104*a* of the select one of the first and second contact blades 104 and 106 contacts two complementary contact blades 204, for instance a first complementary contact blade 204*a* and a second complementary contact blade 204*b*, of the complementary electrical contact 200 when the electrical contact 100 is mated with the complementary electrical contact 200. The second portion 104*b* of the select one of the first and second contact blades 104 and 106 contacts one complementary contact blade 204, for instance a third complementary contact blade 204*c*, of the complementary electrical contact 200 when the electrical contact 100 is mated with the complementary electrical contact 200. In accordance with one embodiment, no complementary contact blade 204 is adjacent to the seam 108 along the lateral direction A when the electrical contact

100 is mated with the complementary electrical contact 200, thereby maximizing current flow between the electrical contact 100 and the complementary electrical contact 200. Thus, the seam 108 can be positioned such that a complementary contact blade 204 of the complementary electrical contact 200 does not lie on the seam 108 when the electrical contact 100 is mated with the complementary electrical contact 200. Though each of the illustrated complementary contact blades 204 define a volume that is substantially equivalent to one another, it will be understood that the size, for instance the volume, of the complementary contact blades 204 can vary as desired.

The electrical contact 100, including the first and second contact blades 104 and 106 and transition region 116, can be made of any suitable electrically conductive material as desired, such as a copper alloy or the metal. The electrical contact 100 can be sized to carry electrical communications or data signals, or to support DC and/or AC power.

In another embodiment, an electrical cable assembly includes at least one electrical conductor that extends from a first end to a second end, and an electrical insulator surrounding the at least one electrical conductor, such that at least the first end extends out from the electrical insulator, and such that the first end is attached to the mounting portion 114 of the electrical contact 100 so as to establish an electrical connection between the at least one electrical conductor and the electrical contact 100.

Example methods of constructing the electrical contact 100 are provided. An example method can include shaping a monolithic piece of electrically conductive material, for instance a copper alloy or other metal, so as to define the seam 108. Alternatively, or additionally, the method can include shaping a monolithic piece of electrically conductive material so as to define the mounting portion 114, the mating portion 102, and the transition region 116. A method of constructing an electrical assembly can include shaping a monolithic piece of electrically conductive material, for instance a copper alloy or other metal, so as to define the mating portion 102 and the mounting portion 114. The method can further include applying a force to the pair of crimp arms 120 of the mounting portion 114 so as to attach a first end of at least one electrical conductor to the electrical contact 100. The method can further include applying a force to a pair of strain relief arms 122 of the mounting portion 114 so that the strain relief arms 122 compress against the electrical insulator so as to attach the electrical insulator to the electrical contact 100.

In operation, an example method of mating the electrical contact 100 with the complementary electrical contact 200 can include causing one or more complementary contact blades 204 of the complementary electrical contact 200 to be received along the mating direction M by the receptacle 112 defined by the first and second contact blades 104 and 106 spaced from each other along the lateral direction A so as to define the receptacle 112. In an example embodiment, the method of mating further includes causing three complementary contact blades 204 of the complementary electrical contact 200 to contact the inner surface 110*c* of the first contact blade 104, and causing three complementary contact blades 204 of the complementary electrical contact 200 to contact the inner surface 110*c* of the second contact blade 106. It will be understood that any number of complementary contact blades 204 can be caused to contact the inner surface 110*c* of the first contact blade 104 and the inner surface 110*c* of the second contact blade 106 as desired. One of the first and second contact blades 104 and 106 can define the seam 108 that separates the first portion 104*a* of the one contact blade from the second portion 104*b* of the one contact blade along the transverse direction T. The method of mating can further include causing two complementary contact blades 204 to contact the first portion 104*a* of the one contact blade, and causing one complementary contact blade 204 to contact the second portion 104*b* of the one contact blade. The method of mating can further include causing a gap, for instance the gap 203, defined by the complementary contact blades 204 to be aligned with the seam 108 when viewed along the lateral direction A.

A method of selling the electrical contact 100 can include teaching to a third party one or more up to all of the above-described method steps, and selling to the third party the electrical contact 100.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed is:

1. An electrical contact comprising:

a mounting portion configured to electrically connect to an electrical cable; and a mating portion spaced from the mounting portion in a forward direction, the mating portion including first and second contact blades spaced from each other a second direction that is substantially perpendicular to the forward direction, each of the first and second contact blades defining a respective first surface and a respective second surface spaced from the respective first surface along a third direction that is substantially perpendicular to both the forward direction and the second direction, wherein one of the first and second contact blades defines a seam elongate along the forward direction, the seam closer to one of the first and second surfaces as compared to the other of the first and second surfaces.

2. The electrical contact as recited in claim 1, wherein the seam extends entirely through the one contact blade along the second direction.

3. The electrical contact as recited in claim 1, wherein each of the first and second contact blades define a rear end and a front end opposite the rear end in the forward direction, and wherein the seam extends from the respective rear end to the respective front end.

4. The electrical contact as recited in claim 1, the electrical contact further comprising:

a transition region that extends from the mating portion to the mounting portion, at least a portion of the transition region defining an outermost dimension that increases in the forward direction.

5. The electrical contact as recited in claim 4, wherein the transition region defines a first end and a second end spaced from the first end in the forward direction, the transition region curved along at least a portion of its length between the first end and the second end.

6. The electrical contact as recited in claim 4, wherein the mating portion further includes 1) a first bridge element that connects the first contact blade and the second contact blade with each other, and 2) a second bridge element that connects the first contact blade and the second contact blade with each other, the transition region connected to at least a portion of at least one of the first bridge element and the second bridge element.

7. The electrical contact as recited in claim 6, wherein the transition region is connected to at least a portion of both of the first and second bridge elements.

8. The electrical contact as recited in claim 6, wherein the first bridge element is disposed on the opposite side of the seam with respect to the second bridge element along the third direction.

9. The electrical contact as recited in claim 6, wherein the first contact blade, the second contact blade, the first bridge element, and the second bridge element are ail monolithic with one another.

10. An electrical contact comprising:

a mounting portion configured to electrically connect to an electrical cable;

a mating portion spaced from the mounting portion in a forward direction, the mating portion configured to mate with a complementary electrical contact, the mating portion including first and second contact blades spaced from each other along a second direction that is substantially perpendicular to the forward direction; and a transition region that extends from the mounting portion to the mating portion, the transition region configured to transmit electrical current between the mating portion and the mounting portion, wherein the transition region defines a first end and a second end spaced from the first end in the forward direction, the first and second ends define first and second heights, respectively, measured along a third direction that is substantially perpendicular to both the forward direction and the second direction, and the second height is greater than the first height, and wherein each of the first and second contact blades define a rear end disposed at the transition region and a front end opposite the rear end in the forward direction, and wherein a select one of the first and second contact blades defines a first portion and a second portion separated from the first portion by a seam that extends from the respective rear end to the respective front end.

11. The electrical contact as recited in claim 10, wherein the transition region flares outwardly from the first end to the second end.

12. The electrical contact as recited in claim 10, wherein the first end is interconnected with the mounting portion, and the second end is interconnected with the mating portion.

13. The electrical contact as recited in claim 10, wherein the first and second contact blades are monolithic with each other.

14. The electrical contact as recited in claim 10, wherein the mounting portion, the mating portion, and the transition region are all monolithic with one another.

15. The electrical contact as recited in claim 10, wherein the transition region is curved along at least a portion of its length between the first end and the second end.

16. The electrical contact as recited in claim 10, wherein the transition region defines upper and lower ends spaced along the third direction, such that the transition region is open along the second direction.

17. The electrical contact as recited in claim 10, wherein the seam is oriented solely along the forward direction.

18. The electrical contact as recited in claim 10, wherein:

each of the first and second contact blades define a first surface and a second surface spaced from the first surface along the third direction, the first portion includes the first surface and a third surface spaced from the first surface along the third direction, the second portion includes the second surface and a fourth surface spaced from the second surface along the third direction, the third and fourth surfaces face each other so as to define the seam, and the seam is spaced closer to one of the first and second surfaces along the third direction as compared to the other of the first and second surfaces.

19. The electrical contact as recited in claim 10, wherein the mating portion further includes 1) at least one first bridge element that connects the first portion of the select one of the first and second contact blades with the other of the first and second contact blades, and 2) at least one second bridge element that connects the second portion of the select one of the first and second contact blades with the other of the first and second contact blades.

* * * * *